US007250866B2

(12) United States Patent
Hall et al.

(10) Patent No.: US 7,250,866 B2
(45) Date of Patent: Jul. 31, 2007

(54) TECHNIQUES FOR DEACTIVATING ELECTRONIC ARTICLE SURVEILLANCE LABELS USING ENERGY RECOVERY

(75) Inventors: Stewart E. Hall, Wellington, FL (US); Carl A. Brooks, Boca Raton, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 189 days.

(21) Appl. No.: 11/144,522

(22) Filed: Jun. 3, 2005

(65) Prior Publication Data

US 2006/0273901 A1 Dec. 7, 2006

(51) Int. Cl.
*G08B 13/14* (2006.01)

(52) U.S. Cl. ..... 340/572.1; 340/501; 340/514; 340/516

(58) Field of Classification Search ..... 340/572.1, 340/572.2, 572.3, 572.4, 572.5, 572.6, 572.7, 340/572.8, 572.9, 506, 507, 501, 514, 516
See application file for complete search history.

(56) References Cited

U.S. PATENT DOCUMENTS

| | | | | |
|---|---|---|---|---|
| 4,263,584 | A * | 4/1981 | Spirig | 340/566 |
| 6,169,483 | B1 * | 1/2001 | Ghaffari et al. | 340/572.3 |
| 2005/0093699 | A1 * | 5/2005 | Leone | 340/572.3 |
| 2006/0289641 | A1 * | 12/2006 | Roesner | 235/435 |

* cited by examiner

*Primary Examiner*—Jeffery Hofsass
*Assistant Examiner*—Edny Labbees

(57) ABSTRACT

A deactivator having a deactivation antenna coil and a capacitor to store energy. The deactivator converts the stored energy to an alternating current over a deactivation period to generate a deactivation magnetic field when driven through the deactivation antenna coil during the deactivation period. The alternating current defines a ring down envelope during the deactivation period. An energy recovery module having an electrical impedance is coupled to the deactivator to recover a portion of the energy converted to the alternating current during a portion of the deactivation period based on the impedance. Other embodiments are described and claimed.

20 Claims, 10 Drawing Sheets

300

400

500

800

900

1000

1600

TECHNIQUES FOR DEACTIVATING ELECTRONIC ARTICLE SURVEILLANCE LABELS USING ENERGY RECOVERY

BACKGROUND

Electronic article surveillance (EAS) systems are used to control inventory and to prevent theft or unauthorized removal from a controlled area of items tagged with EAS security labels. Such systems may include a transmitter and a receiver to establish a surveillance zone (typically entrances and/or exits in retail stores) encompassing the controlled area. The surveillance zone is set-up such that items removed from or brought into the controlled area must traverse the surveillance zone.

An EAS security label may be affixed to an item, such as, for example, an article of merchandise, product, case, pallet, container, and the like. The label includes a marker or sensor adapted to interact with a first signal that the EAS system transmitter transmits into the surveillance zone. The interaction establishes a second signal in the surveillance zone. The EAS system receiver receives the second signal. If an item tagged with an EAS security label traverses the surveillance zone, the EAS system recognizes the second signal as an unauthorized presence of the item in the controlled area and may activate an alarm under certain circumstances, for example. Once an item is purchased, the EAS security label is deactivated so that the alarm is not activated when the label traverses the surveillance zone.

DETAILED DESCRIPTION

EAS labels comprise two strips of material: a resonator made of a high permeability magnetic material that exhibits a magneto-mechanical resonant phenomena and a bias element made of a hard magnetic material. The state of the bias element sets the operating frequency of the label. An active label comprises a magnetized bias element. Demagnetizing the magnetic bias element with a demagnetization module deactivates the label. The demagnetization process may include subjecting the bias element to an intense alternating current (AC) magnetic field with intensity sufficient to overcome the coercive force of the label's bias element over a first period and gradually decreasing the field's intensity along a ring-down decay envelope over a second period to a point close to zero. The decay of the ring-down envelope over the second period may be referred to as the ring-down decay rate, for example. A demagnetization cycle is the time required for the entire demagnetization process occurring over the first and second period. Effective demagnetization may require the application of a strong enough magnetic field to overcome the coercive force of the bias element material prior to decreasing the intensity of the field. The application of the magnetic field during the demagnetization cycle (especially during the ring-down decay period) requires a certain amount of demagnetization energy. A portion of the energy is usually dissipated and wasted.

Embodiments described herein provide recovery of a portion of the demagnetization energy that normally would be wasted. The recovered energy either may be returned to the power source or may be stored in an energy storage device and reused in subsequent deactivation cycles. Embodiments provide high efficiency deactivation coils as well as other module elements, such as inductance (L), capacitance (C), and resistance (R) in the module. Embodiments provide techniques to control the ring-down decay rate of a deactivation module to achieve optimum deactivation performance.

Figure 1:
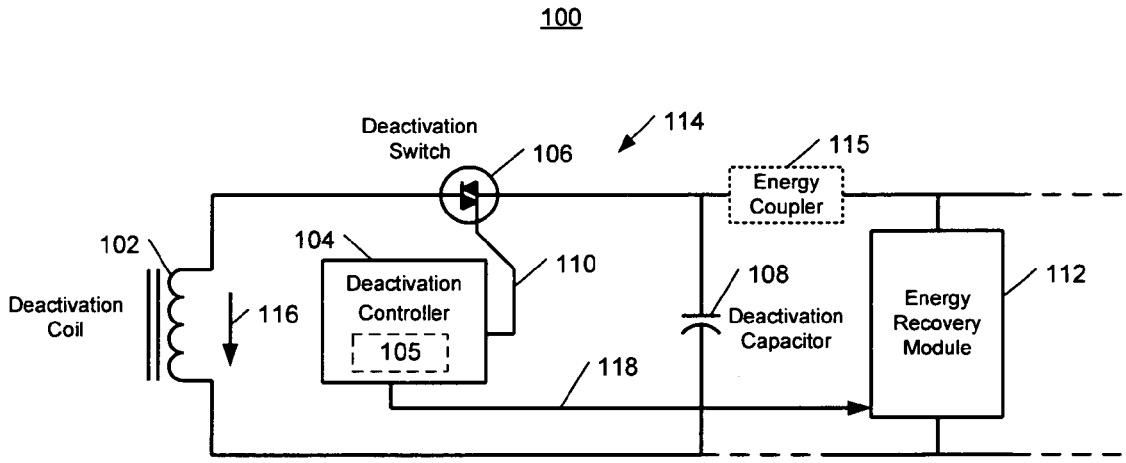
FIG. 1 illustrates a schematic of a module in accordance with one embodiment.

FIG. 1 shows one embodiment of a deactivation and energy recovery demagnetizer module 100 (demagnetizer) comprising a deactivator module 114 (deactivator) and an energy recovery module 112. Demagnetizer 100 may be realized using a variety of deactivators 114 and energy recovery modules 112 in various combinations comprising a variety of architectures and topologies, for example. In one equivalent embodiment, deactivator 114 may comprise an inductor-capacitor-resistor (LCR) resonant tank module. Although the inductive and capacitive elements of the LCR resonant tank may be explicitly provided, in one embodiment, the resistive element may be comprised of the lumped parasitic and lossy resistive characteristics of the LCR module. The deactivator 114 may comprise a deactivation ring-down decay module coupled to an energy recovery module 112 through a deactivation capacitor 108. In one embodiment, the deactivator 114 may be coupled to the energy recovery module 112 through and energy coupler 115. In one embodiment, energy coupler 115 may be a capacitor. In one embodiment, energy coupler 115 may be an inductor. Accordingly, energy recovery module 112 may be capacitively or inductively coupled to the deactivator 114. Capacitor 108 is generally charged prior to the beginning of a deactivation cycle by an energy source or storage device (not shown). In one embodiment, deactivator 114 comprises a deactivation antenna coil 102 (coil) coupled to a deactivation switch 106 (switch). In one embodiment, coil 102 may comprise a coil of wire comprising either an air core or a magnetic core to generate an intense magnetic field in space forming a deactivation zone in proximity of the coil 102. In one embodiment, switch 106 may comprise a triac although other types of switches may be used. Deactivator 114 also may comprise a deactivation and energy recovery control module 104 (controller), coupled to switch 106. Controller 104 may be connected to switch 106 via connection 110 and may be connected to energy recovery module 112 via connection 118.

Controller 104 controls the timing of the deactivation ring-down decay period by controlling switch 106 via connection 110, for example. In one embodiment, controller 104 also may comprise microprocessor 105 to provide a shaped ring-down decay profile over a ring-down decay period. During a deactivation process, an EAS label is brought into the deactivation zone, e.g., within the range of the intense magnetic field, and an intense AC magnetic field is applied to the EAS label. For example, to deactivate an EAS label, during a deactivation period controller 104 turns "on" switch 106 and the energy stored in capacitor 108 is transferred to coil 102 in the form of coil current 116. Current 116 generates a magnetic field to deactivate the EAS label. Deactivator 114 controls switch 106 to begin the demagnetization process and during the ring-down decay period the intensity of the AC magnetic field decreases as the energy originally contained in capacitor 108 is dissipated in the various resistive elements in the LCR resonant tank circuit. The equivalent LCR resonant tank module of deactivator 114 creates the intense and gradually decreasing AC magnetic field. Deactivator 114 charges capacitor 108 with a voltage prior to the start of a deactivation cycle. When the deactivation cycle begins under control of controller 104, switch 106 connects charged capacitor 108 to coil 102. The inductance of coil 102 forms a resonant tank module with capacitor 108. If the lumped equivalent resistances in the resonant tank module are low enough, the LCR module will be under-damped and a gradually decreasing AC current 116 flows through coil 102. Current 116 flows through the winding of coil 102 to create a gradually decreasing AC magnetic field in the deactivation zone. The deactivation cycle is completed when current 116 and the resulting magnetic field decay to a predetermined level. When capacitor 108 is completely recharged, deactivator 114 is ready for another deactivation cycle.

Deactivator coil 102 inductance, resonant capacitor 108 capacitance, and charge voltage on capacitor 108 determine the peak voltage, current 116, and resonant frequency of the deactivator 114 LCR module for a given deactivation cycle. In addition, the size of deactivator coil 102, its winding construction, and the core materials are design parameters that may determine the intensity of the magnetic field and the lossy resistive characteristics of the LCR module of deactivator 114, for example.

Proper deactivation of an EAS label requires that the exponential decay, or ring-down decay, of the AC magnetic field envelope in the deactivation zone decrease at a predetermined rate. In one embodiment, the predetermined rate is limited to a rate in which the magnetic field does not decrease more than 35% from one peak to the next peak of opposite phase, one-half cycle of resonance later. Faster ring-down decay rates are inefficient for deactivating EAS labels. Slower ring-down decay rates work well for deactivating EAS labels that are stationary within the deactivation field. Very slow ring-down decay rates, however, are not desirable because of the resulting very long decay time required for the ring-down decay envelope to reach a very low value near zero at the end of the deactivation cycle. Low resonant frequency deactivators 114 have a limited response time. Thus, a very slow ring-down decay may be less desirable because a fast moving EAS label may not properly deactivate if it moves in and out of the deactivation zone while the deactivator field is still decaying. Accordingly, several embodiments described herein achieve ring-down decay rates between 20% and 30%.

Generally, there are no benefits that may be realized by using highly efficient materials to form deactivator core antennas, such as coil 102 or other components, in conventional deactivator antenna modules using conventional deactivator module. Once a ring-down decay rate of 20-30% is achieved, increases in ring-down decay rates are not beneficial. Very slow ring-down decay rates are not used because of the need for quick deactivation response as previously discussed.

Embodiments that require very large deactivation distances also require very large amounts of energy to deactivate EAS labels. Thus, a very large energy storage capacity is required in deactivation capacitor 108 to create a magnetic field in deactivation coil 102 of sufficiently high intensity to increase the size of the deactivation zone. These embodiments, however, may be expensive and may be impractical due to the size of the power supply necessary to fully recharge deactivation capacitor 108 after each deactivation cycle.

Embodiments that require high efficiency may be battery operated. The battery life, however, may be greatly limited because of the full charge required by capacitor 108 after each deactivation cycle. Embodiments with efficient deactivation coils 102 are not useful if they reduce the ring-down decay rate to less than 20-30% to provide fast and efficient EAS label deactivation.

Embodiments may include high power modules to increase the power levels of the power supply and to average the power supply requirements using large bulk capacitors. Other embodiments include high efficiency modules to reduce the amount of energy stored in deactivator capacitor 108, increase the deactivation range, and increase battery life.

Controller 104 controls the timing of the energy recovery process via connection 118, for example. During the ring-down decay period, controller 104 controls or modulates energy recovery module 112 to recover energy that normally would be wasted during the ring-down decay portion of the deactivation cycle. The various embodiments of energy recovery module 112 described herein may be used to recover energy from deactivator 114 during the resonant ring-down decay period of the deactivation cycle. Embodiments of energy recovery module 112 may recover energy via a direct, inductive, or capacitive coupling connection to deactivator 114. The recovered energy is delivered to a power source or power storage device such as a battery or capacitor. The recovered energy is available for use during subsequent deactivation cycles. Embodiments comprising energy recovery module 112 improve overall power efficiency of demagnetizer 100 by recovering energy that otherwise would be dissipated in deactivator 114 comprising conventional circuitry.

Energy recovery module 112 enables embodiments of highly efficient demagnetizer 100 that normally would ring-down much slower than the desired 20-30% ring-down decay rate. Using energy recovery module 112, the various embodiments provide a method to achieve the desired ring-down decay rate while efficiently recovering energy that otherwise would be dissipated. The recovered energy then may be delivered to a power source or power storage module for use during subsequent deactivation cycles thus increasing the efficient demagnetizer 100. Higher efficiency allows designers to decrease the power supply requirements for deactivator 114 and may allow for the use of high efficiency materials while maintaining an appropriate desirable ring-down decay envelope for quick and effective deactivation.

Figure 2:
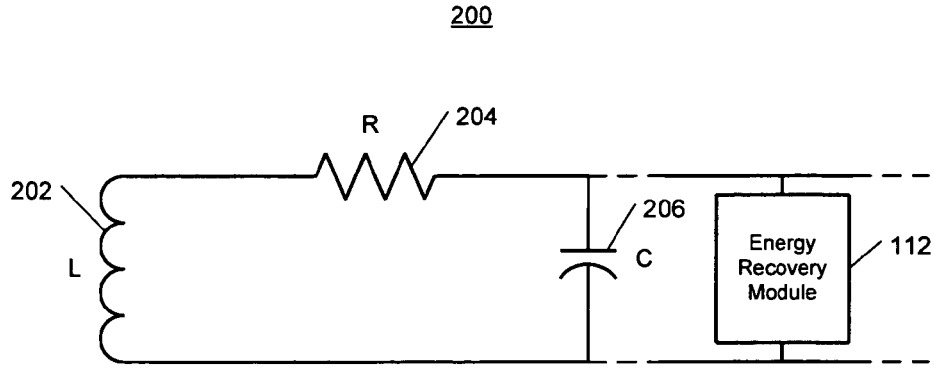
FIG. 2 illustrates a schematic of a module in accordance with one embodiment.

FIG. 2 shows a schematic of one embodiment of an LCR equivalent module 200. In one embodiment, LCR equivalent module 200 of demagnetizer 100 comprises an inductive element 202 (L), representing the inductance of coil 102 and other stray or parasitic inductances, a capacitive element 206 (C), representing the capacitance of deactivation capacitor 108, switch 106, and other stray or parasitic capacitances. Embodiments generally do not include discrete resistive elements in the module. Rather, resistive element 204 (R) is formed by the equivalent series resistance (ESR) of capacitor 108, the ESR of deactivation switch 106, the winding resistance of coil 102, and other losses such as magnetic material losses when a magnetic core is used in coil 102. During a deactivation ring-down decay period elements 202 (L), 204 (R), and 206 (C) form a series LCR module. Embodiments comprise energy recovery module 112 connected either directly or indirectly to the deactivator ring-down decay module.

Figure 3:
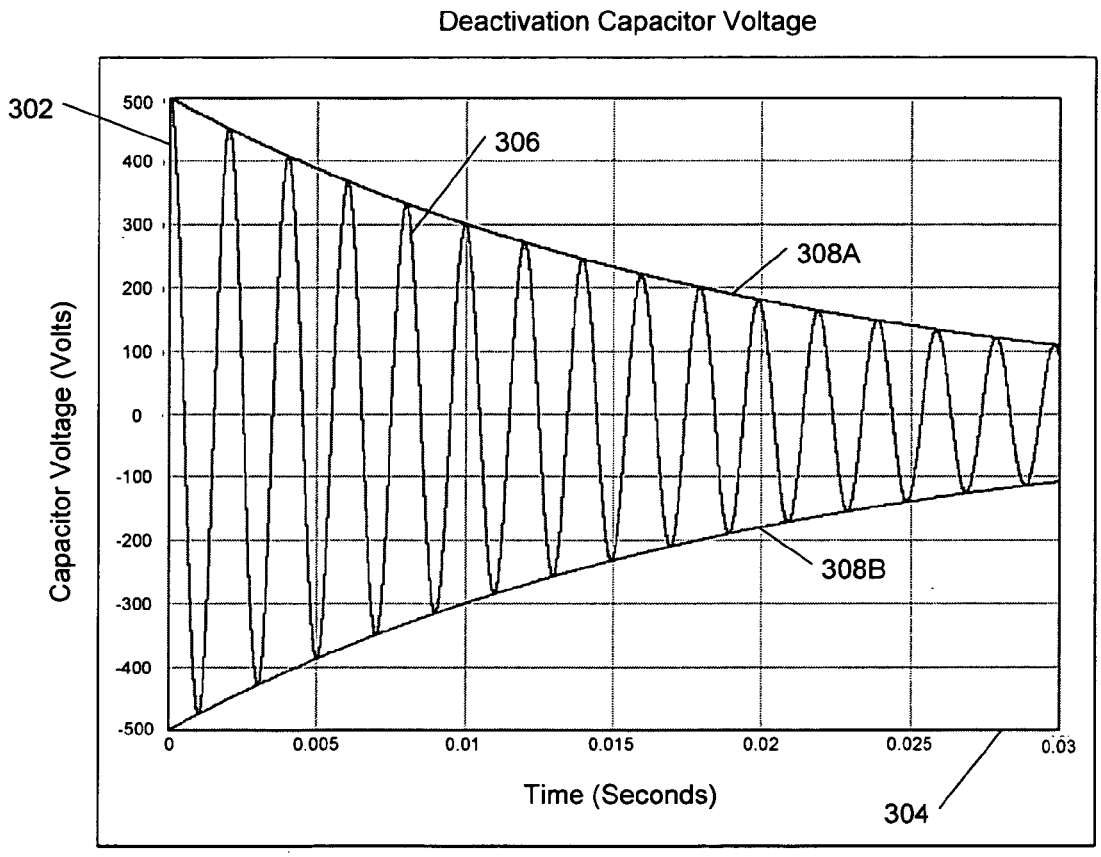
FIG. 3 graphically illustrates a waveform in accordance with one embodiment.

FIG. 3 graphically illustrates at 300 the deactivation capacitor 108 voltage waveform from the time deactivation switch 106 is turned "on," with the capacitor 108 ring-down decay voltage shown on vertical axis 302, and time shown on horizontal axis 304. FIG. 3 shows two graphs. Graph 306 is the capacitor 108 ring-down decay voltage, and graphs 308A, B is the positive and negative envelope of the ring-down decay voltage. Graphs 306 and 308A, B show the deactivation capacitor 108 ring-down decay voltage and decay envelope waveforms without the influence of energy recovery module 112. For example, graph 306 shows the voltage waveform across deactivation capacitor 108 without of energy recovery module 112 load across thereof, and hence no energy recovery. Graphs 308A, B of deactivator ring-down decay voltage waveform of graph 306 comprise a positive portion 308A and a negative portion 308B. Equation (1) below describes the behavior of the voltage waveform of deactivation capacitor 108 in deactivator 114 as a function of time (t). Equation (5) defines the ring-down decay envelope of graphs 308A, B. Note that equation (5) is the first term of Equation (1) and defines the exponential decay rate of the sinusoidal waveform deactivator voltage of graph 306.

$$V_{cap}=V_{init}\cdot e^{-\alpha\cdot t}\cdot\cos(\omega_d\cdot t) \tag{1}$$

Where: $V_{init}$ is the initial voltage on deactivation capacitor 108 and:

$$\alpha=\frac{R}{2\cdot L} \tag{2}$$

$$\omega_o=\sqrt{\frac{1}{L\cdot C}} \tag{3}$$

$$\omega_d=\sqrt{\omega_o^2-\alpha^2} \tag{4}$$

$$V_{env}=\pm V_{init}\cdot e^{-\alpha\cdot t} \tag{5}$$

Figure 4:
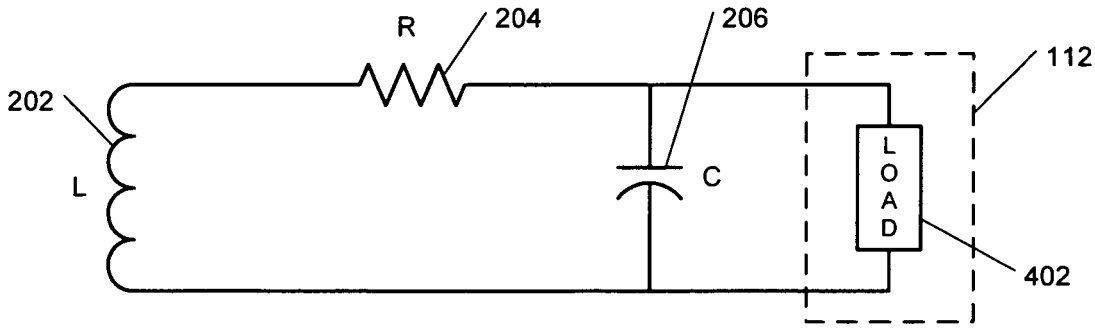
FIG. 4 illustrates a schematic of a module in accordance with one embodiment.

FIG. 4 shows a schematic of one embodiment of an LCR equivalent module 400 of demagnetizer 100 shown in FIG. 1 comprising energy recovery module 112 in parallel with capacitive element 206 (C). Equivalent module 400 also comprises inductive element 202 (L) and resistive element 204 (R). Energy recovery module 112 may be represented by equivalent load 402 (Re). In one embodiment, energy recovery module 112 may present a constant parallel load 402 to deactivation capacitor 206. A control module, however, may be used to control the parallel load 402 so that the amount of energy that is extracted from module 400 varies as a function of time during a deactivation ring-down decay period. This is described in further detail below. The voltage across deactivation capacitor 206 may be approximated in accordance with Equation (6), for example. Energy recovery module 112 may deliver the extracted energy efficiently back to the energy source or to an energy storage module, described below, resulting in energy savings.

$$V_{cap}=V_{init}\cdot e^{-\alpha\cdot t}\cdot\cos(\omega_d\cdot t) \tag{6}$$

Where: $V_{init}$ is the initial voltage on deactivation capacitor 206 and:

$$\alpha=\frac{1}{2}\cdot\left(\frac{R}{L}+\frac{1}{\mathrm{Re}\cdot C}\right) \tag{7}$$

$$\omega_o=\sqrt{\frac{R+\mathrm{Re}}{\mathrm{Re}\cdot L\cdot C}} \tag{8}$$

$$\omega_d=\sqrt{\omega_o^2-\alpha^2} \tag{9}$$

Equations (7)-(8) are adapted from Principles of Solid-State Power Conversion," Ralph E. Tarter, 1985, Howard W. Sams, pgs. 33-36.

Figure 5:
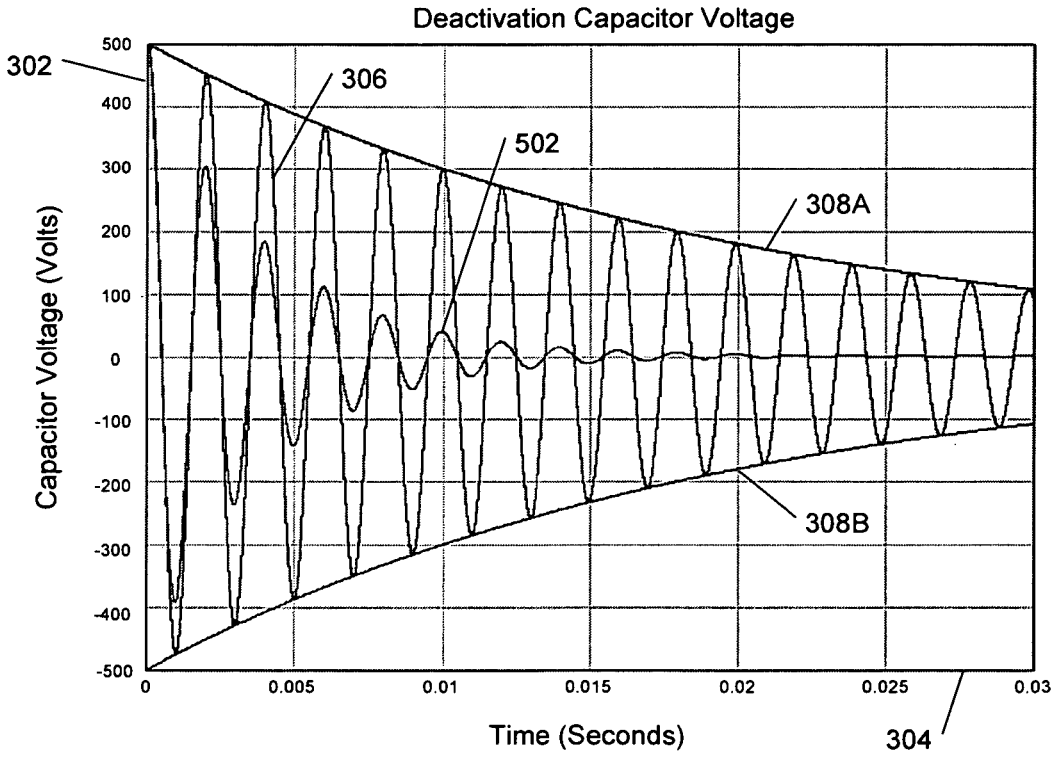
FIG. 5 graphically illustrates a waveform in accordance with one embodiment.

FIG. 5 graphically illustrates at 500 a voltage waveform across deactivation capacitor 108 from the time deactivation switch 106 turned "on," with capacitor 108 voltage shown on vertical axis 302 and time shown on horizontal axis 304. FIG. 5 shows three graphs. As previously described, graph 306 is the capacitor 108 ring-down decay voltage without energy recovery, graphs 308A, B is the decay envelope, and graph 502 is the capacitor ring-down decay voltage with the influence of energy recovery module 112. To provide a comparison, graphs 306 and 308A, B show the deactivation capacitor 108 ring-down decay voltage and decay envelope waveforms without the energy recovery function of energy recovery module 112, and graph 502, is the capacitor 108 ring-down decay voltage with the load influence of energy recovery module 112 across thereof. FIG. 5 demonstrates that energy contained in a deactivation ring-down decay module, e.g., deactivator 114, for example, may be extracted by energy recovery module 112 so that the capacitor 108 ring-down decay voltage of demagnetizer 100 decays much more rapidly than it does in the natural ring-down decay voltage that follows the envelope shown in graphs 308A, B, for example.

Figure 6:
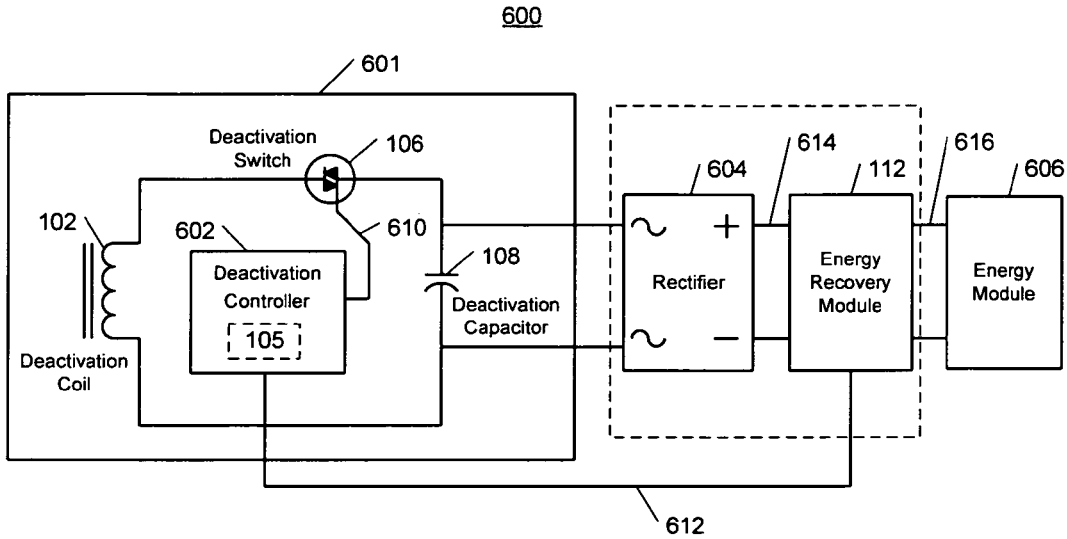
FIG. 6 illustrates a block diagram in accordance with one embodiment.

FIG. 6 shows a block diagram of one embodiment of a deactivation and energy recovery demagnetizer module 600 (demagnetizer). In one embodiment, demagnetizer 600 comprises deactivator 601, rectifier 604, energy recovery module 112, and energy module 606, which may comprise an energy source or an energy storage device, for example. Deactivator 601 comprises coil 102 connected to switch 106, which in turn is connected to capacitor 108. Deactivation and energy recovery control module 602 (controller) may control the deactivation function via connection 610 to switch 106 and may control the energy recovery function via connection 612 to energy recovery module 112. Control module 602

(controller) controls the voltage decay waveform across deactivation capacitor 108. In one embodiment, controller 602 also may comprise microprocessor 105 to provide a shaped ring-down decay profile over a ring-down decay period. In one embodiment, energy recovery module 112 may be connected across deactivation capacitor 108. Other embodiments may provide energy recovery module 112 connected across coil 102 (not shown) or connected to demagnetizer 600 via capacitive or inductive coupling (not shown). In one embodiment, a rectifier 604 may be provided between deactivation capacitor 108 and energy recovery module 112. Rectifier 604 may be either a full wave or half wave rectifier 604. Rectifier 604 rectifies the deactivation capacitor 108 voltage. The rectified voltage is subsequently fed to the input of energy recovery module 112 at input terminal 614, for example. Energy recovery module 112 transforms the recovered energy and provides it to energy module 606 via output terminal 616. In one embodiment, energy module 606 may be a battery or other device that produces electricity, for example. In one embodiment, energy module 606 may be a capacitor, rechargeable battery or other energy storage device, for example, such that recovered energy may be stored for later use.

Embodiments of energy recovery module 112 vary depending on the desired characteristics of the energy module 606. In general, embodiments of energy recovery module 112 may comprise a switch and an inductive element, such as an inductor or a transformer to accomplish the transformation, for example. In one embodiment, the switch may comprise a high frequency switch and the inductive element may comprise a high frequency inductive element. Embodiments of energy recovery module 112 may comprise switching regulators of various topologies to accomplish the energy recovery function, for example. The selection of a particular topology depends on the input/output characteristics. For example, the expected input voltage of deactivation capacitor 108, the output voltage fed to energy module 606, the loading effects of energy recovery module 112, and the operating power level of energy recovery module 112.

Figure 7:
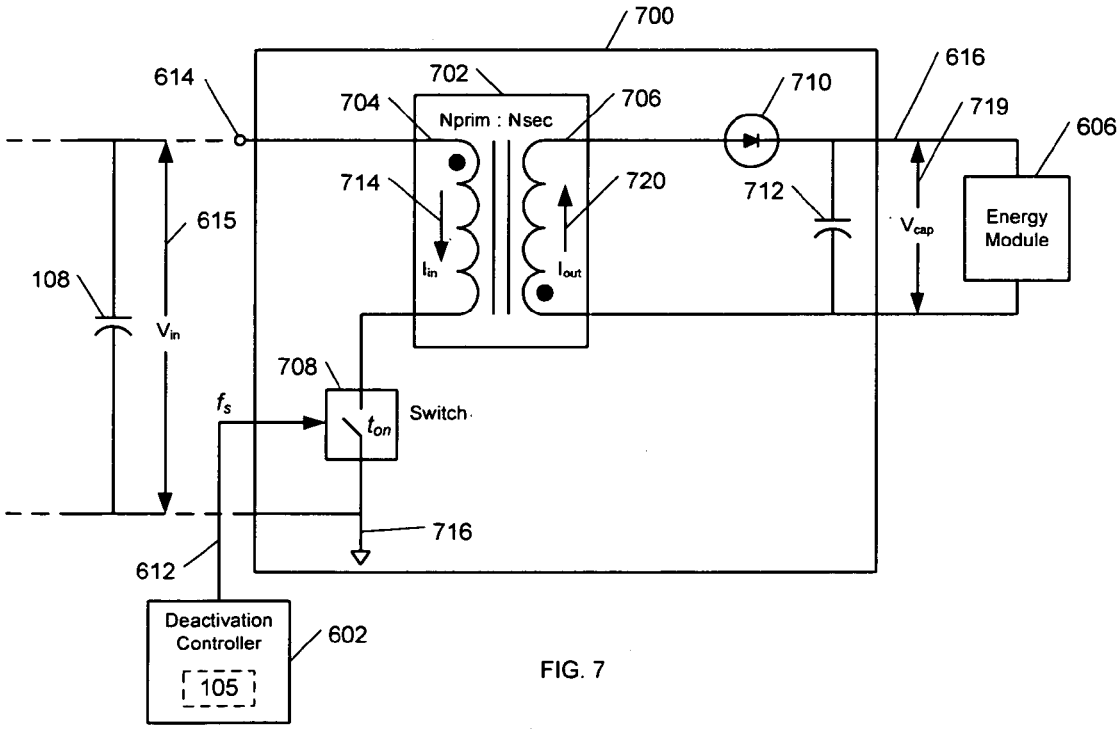
FIG. 7 illustrates a diagram in accordance with one embodiment.

FIGS. 7, 13, 14, and 15 show several diagrams of topologies of switching regulators/converters (regulator) suitable to implement energy recovery module 112, for example. These topologies may comprise an isolated flyback regulator, a boost regulator, a buck regulator, and a single-ended primary inductance regulator (SEPIC), for example. Although each of these topologies may be suitable for various combinations of voltage and power levels, these do not represent an exhaustive list of topologies that may be used to implement energy recovery module 112 in accordance with the embodiments described herein. Although a description of the structure of the various topologies is provided herein, an example of the operation of these various topologies is described with reference to the isolated flyback topology as shown in FIG. 7, for example.

FIG. 7 shows one embodiment of energy recovery module 112 comprising an isolated flyback regulator 700 topology. Isolated flyback regulator 700 may comprise coupled inductor 702 comprising primary winding 704 and secondary winding 706, for example. On one end, primary winding 704 is connected to rectifier 604 at input terminal 614. On the other end, primary winding is connected to switch 708. In one embodiment, switch 708 may be a high frequency switch, for example. Secondary winding 706 is connected to series diode 710, which in turn is connected to parallel capacitor 712. The voltage developed across capacitor 712 is fed to energy module 606 via output terminal 616. $V_{in}$ 615, from rectifier 604 for example, is received at input terminal 614 and is fed to primary winding 704. When switch 708 is turned "on" for a predetermined period, it provides a return path to ground and $V_{in}$ 615 causes current $I_{in}$ to flow in the direction indicated by arrow 714. Switch 708 is turned "on" or modulated for a predetermined period by pulses generated by controller 602 at frequency $f_s$ and are fed to switch 708 via connection 612. Thus, controller 602 controls the transformation of current $I_{in}$ in coupled inductor 702. Energy is stored in coupled inductor 702 when switch 708 is turned "on." When switch 708 turns "off," current $I_{out}$ is released into capacitor 712. Current $I_{in}$ is thus "transformed" into current $I_{out}$. Energy recovery current $I_{out}$ flowing in the direction indicated by arrow 720 is fed to series diode 710 and charges capacitor 712 to voltage $V_{cap}$ 719. The output capacitor voltage $V_{cap}$ 719 is fed to energy module 606 via connection 616. Thus, energy recovery module 112 transforms the energy in $I_{in}$ applied to coupled inductor 702 at input terminal 614 and feeds it to energy module 606 via connection 616 under the control of controller 602 and switch 708. Capacitor voltage $V_{cap}$ 719 feeds or charges energy module 606, which may comprise a battery, rechargeable battery, capacitor or other electrical energy source or storage device.

In one embodiment, the on-time $t_{on}$ of switch 708 may be defined by equation (10) as follows:

$$t_{on} = \sqrt{\frac{2 \cdot Lp}{fs \cdot R_{load}}} \tag{10}$$

where $t_{on}$, is the on-time of switch 708; $L_p$ is the inductance of primary winding 704 of transformer 702; $f_s$ is the switching frequency of flyback regulator 700 as controlled by controller 602; and $R_{load}$ is the average resistive load applied to deactivation capacitor 108 by flyback regulator 700.

Those skilled in the art will appreciate that equation (10) provides that with a constant switching frequency ($f_s$) from controller 602 and a constant switch 708 on-time ($t_{on}$), flyback regulator 700 presents a constant average load to deactivation capacitor 108. The inductance (Lp) of primary winding 704 may be appropriately chosen to accommodate a maximum voltage on deactivation capacitor 108 and the switching frequency of deactivator 601 (e.g., the switching frequency applied to switch 106 through connection 610). Accordingly, flyback regulator 700 may operate in the discontinuous mode at a fixed frequency and fixed duty cycle to present an average constant resistance load to deactivator 601, for example.

Figure 8:
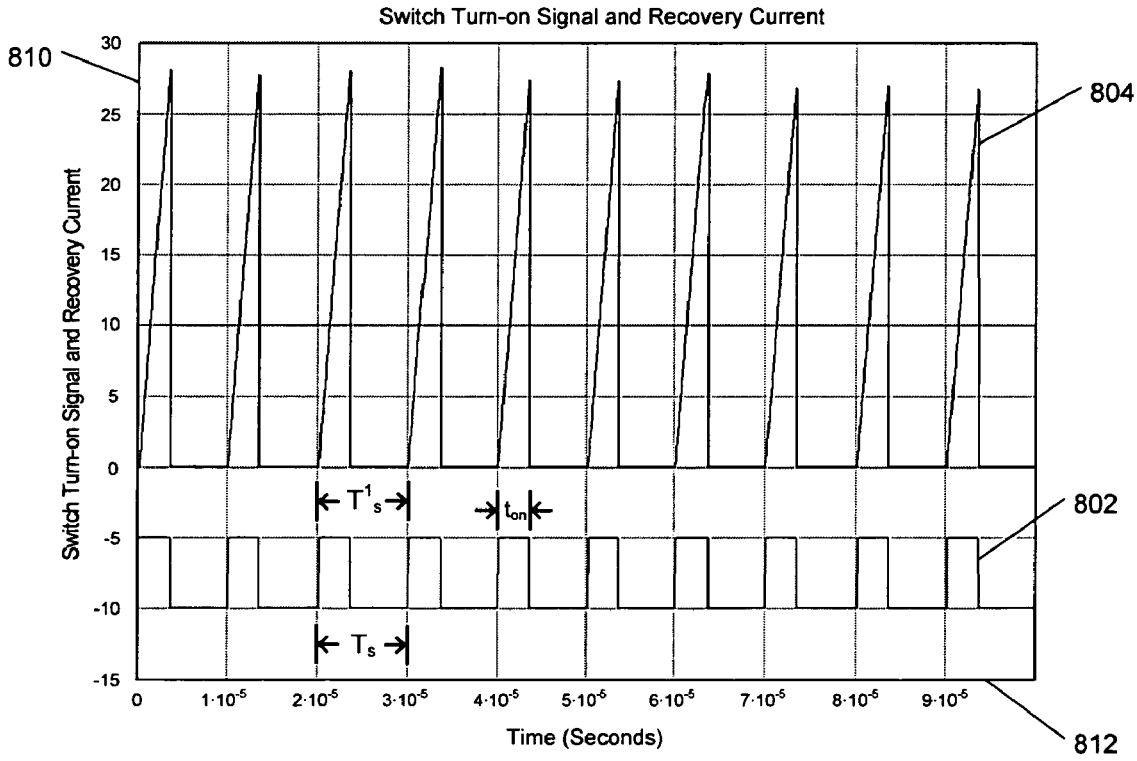
FIG. 8 graphically illustrates a waveform in accordance with one embodiment.

FIG. 8 graphically illustrates at 800 the relationship between the switch 708 turn-on signal and the energy recovery current $I_{in}$, with the switch 708 turn-on signal and the energy recovery current $I_{in}$ shown on vertical axis 810, and time shown on horizontal axis 812. FIG. 8 shows two graphs. Graph 802 is the switch 708 turn-on signal and graph 804 is the corresponding energy recovery current $I_{in}$. Graph 802 shows the switching period $T_s$ (i.e., at switching frequency $f_s=1/T_s$) of switch 708 and the corresponding on-time period $t_{on}$ of switch 708. In one embodiment, the switch 708 on-time period $t_{on}$, may remain constant throughout the duration of a ring-down decay period. Graph 804 shows the period $T^1_s$ of recovery current $I_{in}$ signal. As shown, the recovery current $I_{in}$ signal period $T^1_s$ tracks the switch 708 turn-on period $T_s$.

Figure 9:
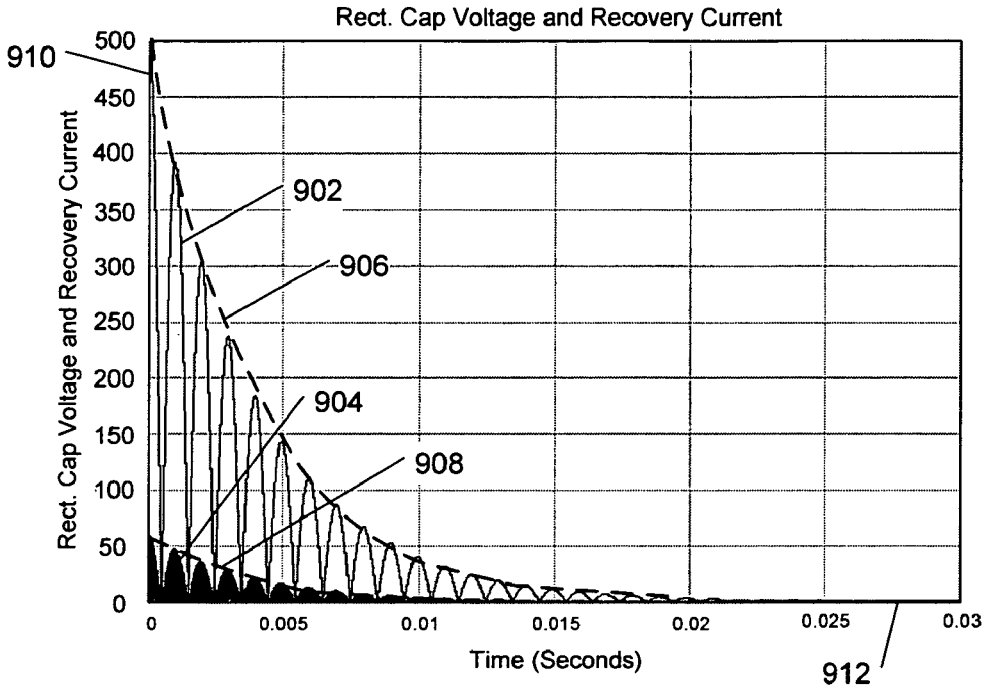
FIG. 9 graphically illustrates a waveform in accordance with one embodiment.

FIG. 9 graphically illustrates at 900 deactivation capacitor 108 voltage $V_{in}$ 615 after passing through rectifier 604, for example, and the resulting high frequency energy recovery current $I_{in}$, with the rectified deactivation capacitor 108 voltage $V_{in}$ 615 and the resulting high frequency energy recovery current $I_{in}$ shown on vertical axis 910, and time shown on horizontal axis 912. FIG. 9 shows four graphs. Graph 902 is the rectified capacitor 108 voltage $V_{in}$ 615, graph 904 is the high frequency energy recovery current $I_{in}$, graph 906 is the decay envelope of $V_{in}$ 615, and graph 908 is the decay envelope of high frequency energy recovery current $I_{in}$. Graph 902 for the rectified capacitor voltage $V_{in}$ 615 and graph 904 for the high frequency recovery current $I_{in}$ are the waveforms generated by demagnetizer 600 comprising an energy recovery module 112 implementation comprising flyback regulator 700 operating at a constant switching frequency ($f_s$) and constant switch 708 on-time ($t_{on}$). Graph 902 is the resulting rectified input voltage $V_{in}$ 615 fed to primary winding 704 and graph 904 is the resulting high frequency energy recovery current $I_{in}$ flowing through primary winding 704. Flyback regulator 700 operating at a constant switching frequency ($f_s$) and constant switch 708 on-time ($t_{on}$) provides a constant resistive load to deactivation capacitor 108 during the ring-down decay period T portion of the deactivation period. The rectified voltage $V_{in}$ 615 from deactivation capacitor 108 is fed to input terminal 614 of flyback regulator 700 and produces the resulting energy recovery current $I_{in}$ when switch 708 turns "on" for period $t_{on}$. As shown in graph 908, the decay envelope of high frequency energy recovery current $I_{in}$ flowing in primary winding 704 tracks the decay envelope of rectified deactivator capacitor voltage $V_{in}$ 615 shown in graph 906 throughout ring-down decay period T (e.g., approximately 0.02 seconds as shown at 900).

Figure 10:
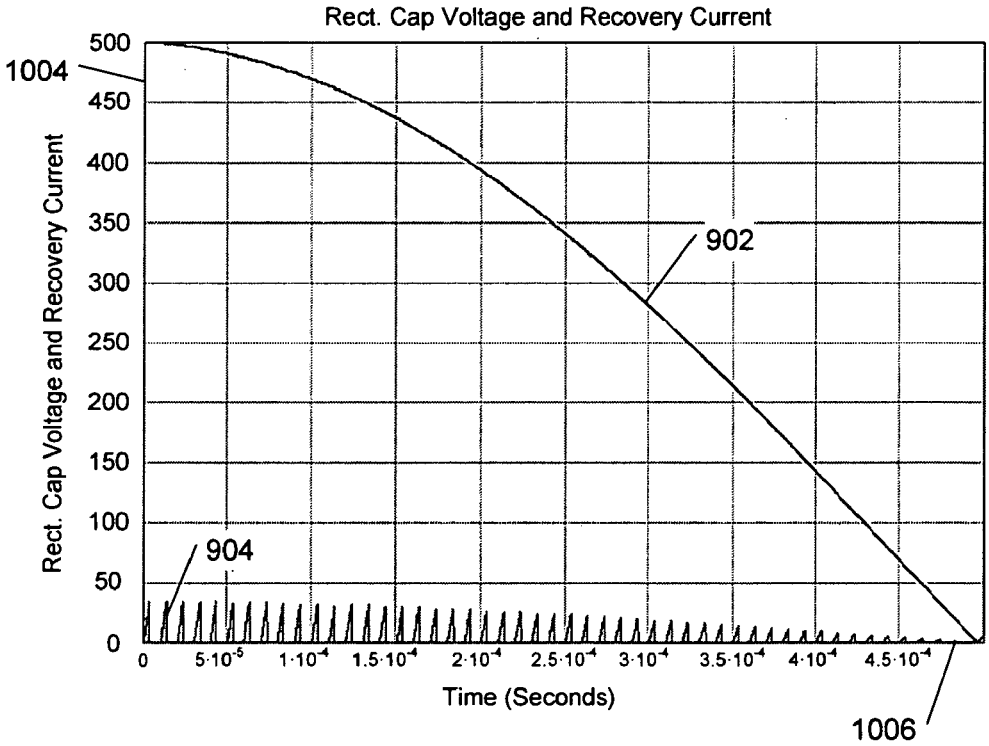
FIG. 10 graphically illustrates a waveform in accordance with one embodiment.

FIG. 10 graphically illustrates at 1000 a magnified view of the first quarter cycle of deactivation ring-down decay period T of rectified capacitor 108 voltage $V_{in}$ 615 shown in graph 902 of FIG. 9, and the current waveform $I_{in}$ of flyback regulator 700 operating in discontinuous mode, with the rectified deactivation capacitor 108 voltage $V_{in}$ 615 and the resulting high frequency energy recovery current $I_{in}$ shown on vertical axis 1004, and time shown on horizontal axis 1006. FIG. 10 shows two graphs. Graph 902 is the rectified capacitor 108 voltage $V_{in}$ 615 and graph 904 is for the high frequency energy recovery current $I_{in}$.

Embodiments previously described with reference to FIGS. 7-10, are representative of one example of an isolated flyback regulator 700 topology of energy recovery module 112 operating as a constant resistance load to deactivation capacitor 108 throughout the duration of ring-down decay period T of deactivator 601, for example. Other embodiments, however, may provide microprocessor 105 to provide a shaped ring-down decay profile over the ring-down decay period T to further improve deactivation performance. In one embodiment, microprocessor 105 may be used to control the shape of the ring-down decay profile over separate portions of the deactivation ring-down decay period. For example, embodiments under control of microprocessor 105 may provide an adjustable duty cycle rather than a fixed duty cycle, of the ring-down decay period T. Microprocessor 105 may be used to vary the ring-down decay envelope such as that shown in graph 908 of FIG. 9, during different portions of the ring-down decay period T. For example, microprocessor 105 may be used to control the ring-down decay rate such that it dwells at a slow ring-down decay rate during a first portion of (e.g., the first few cycles) of the deactivation period and then increase the ring-down decay to a faster rate during a second portion (e.g., towards the end) of the deactivation period. With reference to FIGS. 1 and 6, controllers 104 and 602, respectively, may comprise, or may be controlled by, microprocessor 105 to control ring-down decay during different portions of the deactivation period T. In one embodiment, deactivators 114, 601 may comprise, or may be controlled by, microprocessor 105 to control the decay at a slow ring-down decay rate during the first several cycles of the deactivation period T and to decay at a fast ring-down decay rate later in the deactivation period T.

Figure 11:
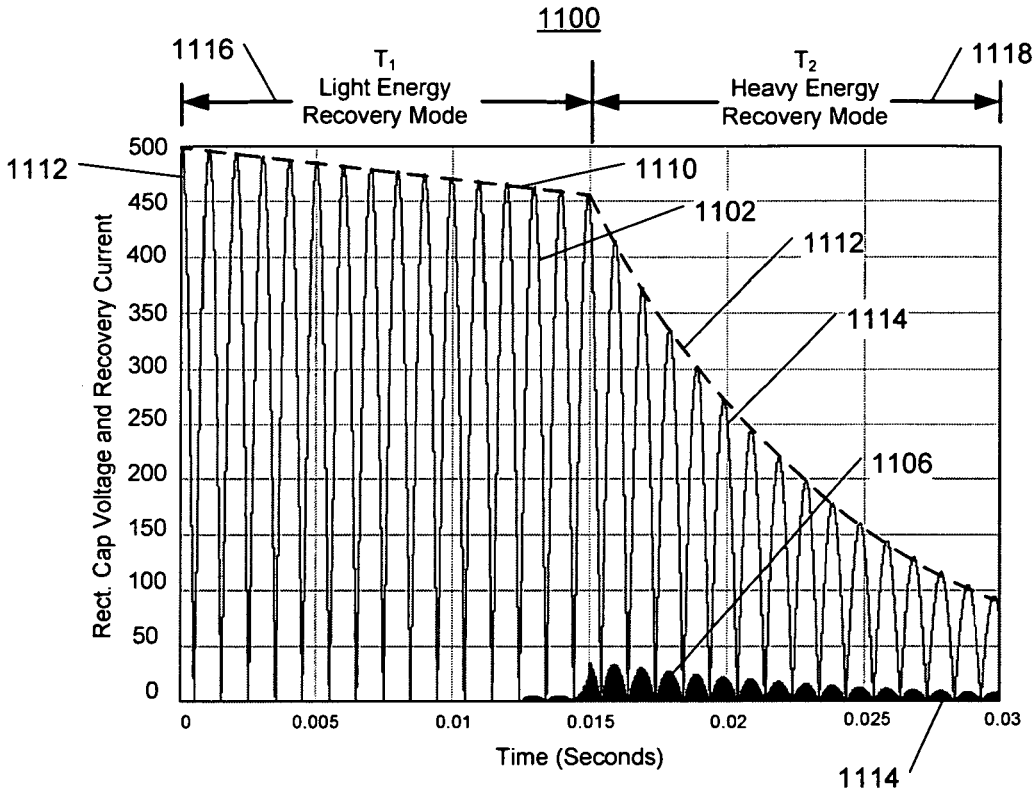
FIG. 11 graphically illustrates a waveform in accordance with one embodiment.

FIG. 11 graphically illustrates at 1100 the rectified deactivation capacitor 108 voltage $V_{in}$ 615 and the resulting high frequency energy recovery current $I_{in}$, with a shaped ring-down decay profile controlled by microprocessor 105 for energy recovery module 112 comprising an isolated flyback regulator 700 topology. In one embodiment, energy recovery module 112 may be operated as a variable resistance load with respect to deactivation capacitor 108 throughout the duration of ring-down decay period T of deactivator 601. Microprocessor 105 may be used to control the variable loading characteristics of energy recovery module 112 over multiple periods (e.g., T1, T2, and so on) throughout the duration of ring-down decay period T. In one embodiment, the loading characteristic of energy recovery module 112 may be adjusted to affect the shape of the ring-down envelope, for example. The rectified deactivation capacitor 108 voltage. $V_{in}$ 615 and the resulting high frequency energy recovery current $I_{in}$ are shown on vertical axis 1112, and time is shown on horizontal axis 1114. FIG. 11 shows five graphs. Graph 1102 is the rectified capacitor voltage $V_{in}$ 615 during a light energy recovery period $T_1$ 1116. Graph 1104 is the rectified capacitor voltage $V_{in}$ 615 during a heavy energy recovery period $T_2$ 1118. Graph 1106 is the energy recovery current $I_{in}$ that is available for recovery during $T_2$. Graph 1110 is the decay rate envelope over period $T_1$ of rectified $V_{in}$ 615 voltage. Graph 1112 is the rectified $V_{in}$ 615 decay rate envelope over period $T_2$. FIG. 11, shows one example of a microprocessor controlled shaped ring-down decay profile where the load (e.g., resistance) presented to deactivation capacitor 108 by energy recovery module 112 (e.g., input impedance of flyback regulator 700) is adjusted at different times during the deactivation ring-down decay period by a microprocessor in controller 602, for example.

Depending on the specific embodiments, the changes in the deactivation ring-down decay envelope may improve deactivation performance, for example. Deactivation capacitor voltage $V_{in}$ 615 and energy recovery current $I_{in}$ are generated as the effective load resistance of energy recovery module 112 is adjusted from a "light energy recovery mode" during period $T_1$ 1116 to a "heavy energy recovery mode" 1118 during period $T_2$. This changes the ring-down decay rate from envelope 1110 over period $T_1$ to the envelope 1112 over period $T_2$, for example. As shown in graph 1106, there is a corresponding change in the decay rate of the respective recovery current $I_{in}$. As discussed previously, the effective load resistance of energy recovery module 112 may be microprocessor controlled which may be located either within controller 104, 602, or may be formed integrally with energy recovery module 112.

Figure 12:
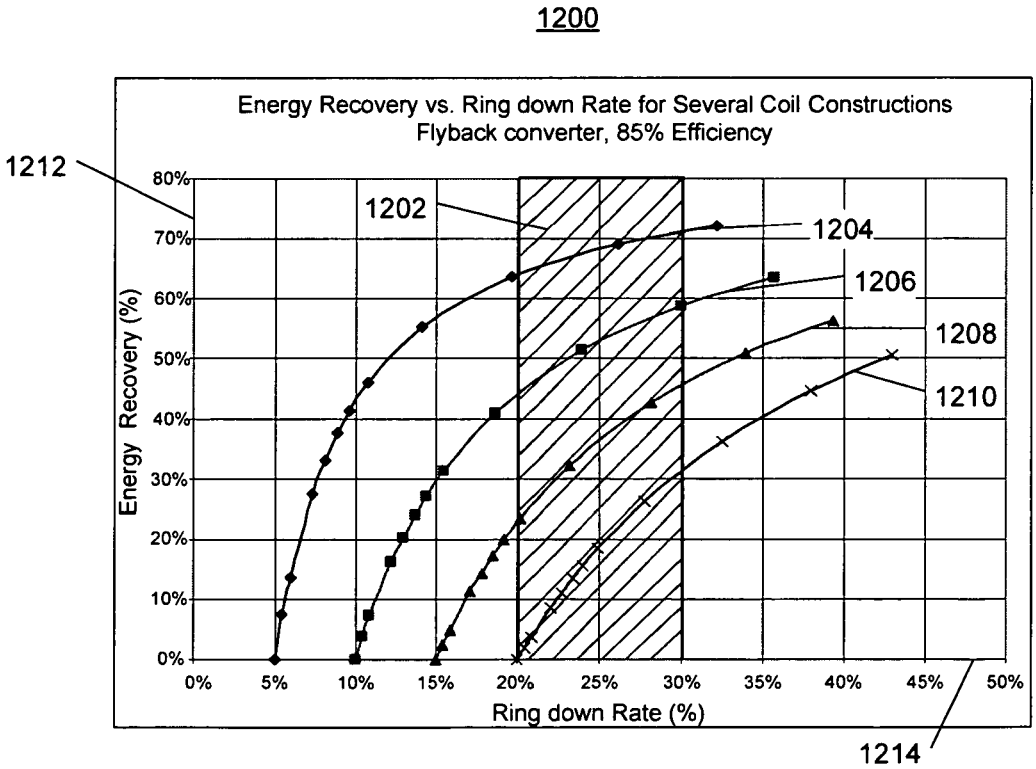
FIG. 12 graphically illustrates a diagram in accordance with one embodiment.

FIG. 12 graphically illustrates at 1200 energy recovery percentage versus ring-down decay rate percentage for several coil constructions of flyback regulator 700 with an average efficiency of 85%, for example. Energy recovery percentage is shown on vertical axis 1212, and ring-down decay rate percentage is shown on horizontal axis 1214. The various energy recovery levels may be achieved for different embodiments of energy recovery module 112, for example. FIG. 12 provides energy recovery rates for ring-down decay module 114 coupled to or connected with energy recovery module 112 configured in isolated flyback regulator 700 topology. Other topologies will use similar high frequency switching techniques, but may yield somewhat different waveforms. FIG. 12 shows five graphs. Graph 1202 is a range of ring-down decay rates of 20-30%. Graph 1204 is for a deactivator 114, 601 with a natural ring-down decay rate efficiency of 5%. Graph 1206 is for a deactivator 114, 601 with a natural ring-down decay rate efficiency of 10%. Graph 1208 is for a deactivator 114, 601 of with a natural ring-down decay rate efficiency of 15%. Graph 1204 is for a deactivator 114, 601 with a natural ring-down decay rate efficiency of 20%. The efficiencies of the various embodiments may range from a natural ring-down decay rate of 5% as shown by graph 1204, to natural ring-down decay rate of 10% as shown by graph 1206, to a natural ring-down decay rate of 15% as shown by graph 1208, and to a natural ring-down decay rate of 20% as shown by graph 1210, for example. Simulations using a flyback regulator 700 type energy recovery module 112 with 85% average efficiency may be used to predict an estimate of the amount of energy that may be recovered from a deactivator 114, 601 under different operating conditions, for example. In one embodiment, the simulations may be conducted using flyback regulator 700 connected to deactivation capacitor 108. Further, in this example analysis, the equivalent load associated with flyback regulator 700 is held constant throughout the ring-down decay period. To generate the graphs shown in FIG. 12, the energy recovery load was varied to provide estimates of percentage energy recovery vs. the resulting ring-down decay rate.

Table 1 shows the estimated energy recovery of various embodiments comprising various ring-down decay rates and deactivator 114, 601 efficiencies for a ring-down decay rate of between 20%-35%. As shown, embodiments of deactivator 114, 601 exhibiting very high efficiency provide the potential for very high energy savings of between 60% and 70%. Even embodiments of deactivator 114, 601 exhibiting lower efficiency offer potential for energy savings of 20%-30%, for example. For example, for a target ring-down decay rate of 30% and a natural ring-down rate of 10%, the estimated energy recovery is 59%.

TABLE 1

| Natural Ring-Down | Target Ring-Down Decay Rate | | | |
|---|---|---|---|---|
| Decay Rate | 20% | 25% | 30% | 35% |
| 5% | 63% | 68% | 71% | 73% |
| 10% | 43% | 52% | 59% | 62% |
| 15% | 22% | 37% | 46% | 52% |
| 20% | 0% | 19% | 31% | 40% |

Figure 13:
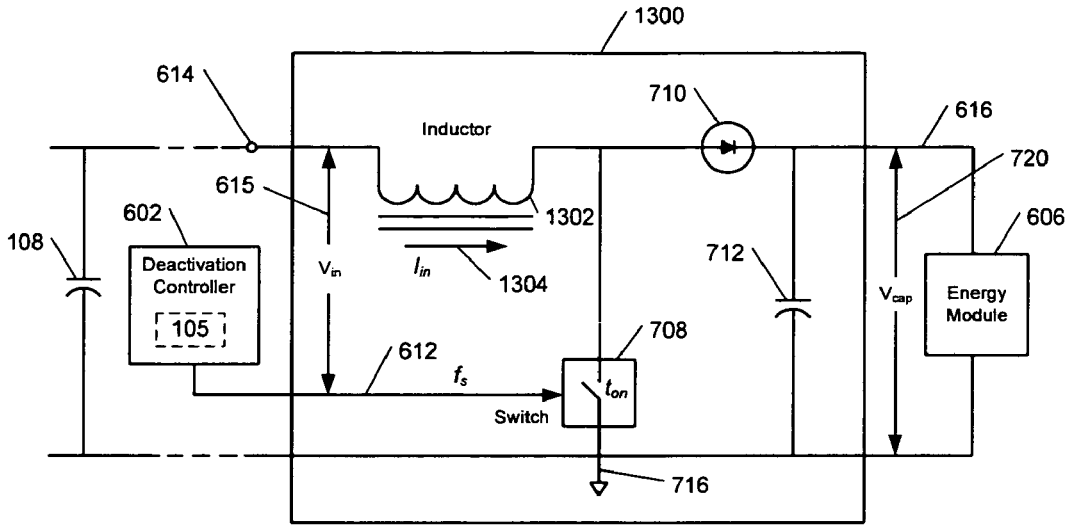
FIG. 13 illustrates a diagram in accordance with one embodiment.

FIG. 13 illustrates one embodiment of energy recovery module 112 comprising regulator 1300 arranged in a boost topology. In one embodiment, regulator 1300 may comprise inductor 1302 having one end connected to input terminal 614, for example, and to capacitor 108. In one embodiment inductor 1302 may be a high frequency power inductor, for example. The other end of inductor 1302 may be connected in series with one end of diode 710. The other end of diode 710 may be connected to parallel capacitor 712. Capacitor 712 may be connected to energy module 606 via output terminal 616. As previously discussed with reference to FIG. 6, the capacitor 108 voltage may be rectified by rectifier 604. For example, $V_{in}$ 615 may be rectified before it is applied to the input of inductor 1302 at input terminal 614. Switch 708 is connected at the junction of inductor 1302 and diode 710. When switch 708 is turned "on" for period $t_{on}$ (FIG. 8) it provides a conduction path to ground 716. Controller 602 controls or modulates switch 708. Controller 602 generates pulses 802 (FIG. 8) at frequency $f_s$. The pulses 802 are applied to connection 612 to control switch 708, and thus control the transformation of rectified $V_{in}$ 615. Accordingly, during a turn-on period $t_{on}$, $V_{in}$ 615 causes an energy recovery current $I_{in}$ pulse to flow through high frequency power inductor 1302 in the direction indicated by arrow 1304. Accordingly, during the entire deactivation period switch 708 is operated at a frequency of $f_s$ and, accordingly, a plurality of energy recovery $I_{in}$ current pulses flow in the direction indicated by arrow 1304, pass through diode 710, and charge capacitor 712. As a result, voltage $V_{cap}$ 720 is stored in capacitor 712 and is fed to energy module 606 via connection 616 for recovery. Capacitor voltage $V_{cap}$ 720 charges energy module 606, which may comprise a battery, rechargeable battery, capacitor or other electrical energy source or storage device. Accordingly, regulator 1300 transforms the energy supplied by $V_{in}$ rectified 615 applied at input terminal 614 and delivers it to energy module 606 via connection 616 under the control of controller 602 and switch 708.

Figure 14:
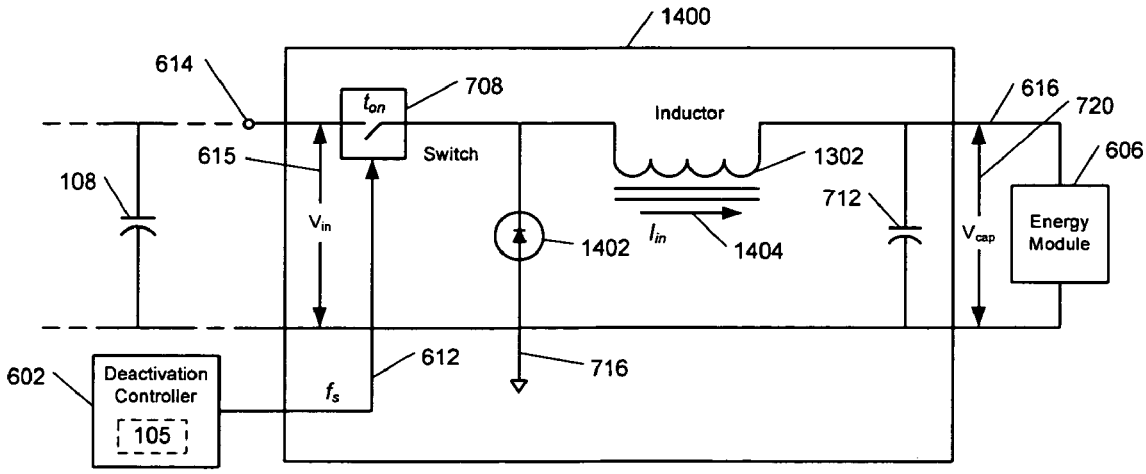
FIG. 14 illustrates a diagram in accordance with one embodiment.

FIG. 14 illustrates one embodiment of energy recovery module 112 comprising regulator 1400 arranged in a buck topology. In one embodiment, switch 708 may be connected between input terminal 614 and one end of inductor 1302. Diode 1402 may be connected to the junction of switch 708 and inductor 1302. The other end of diode 1402 may be connected to ground 716. The other end of inductor 1302 may be connected to parallel capacitor 712. Capacitor 712 may be connected to energy module 606 via output terminal 616. When switch 708 is turned "on" for period $t_{on}$ (FIG. 8) it provides a conduction path between input terminal 614 and inductor 1302. Controller 602 controls the operation of switch 708. Controller 602 generates pulses 802 (FIG. 8) at frequency $f_s$. These pulses 802 are applied to connection 612 to control switch 708, and thus control the transformation of rectified $V_{in}$ 615. Accordingly, during turn-on period $t_{on}$, $V_{in}$ rectified 615 causes an energy recovery current $I_{in}$ pulse to flow through inductor 1302 in the direction indicated by arrow 1404. Accordingly, during the entire deactivation period, switch 708 is operated at a frequency of $f_s$ and a plurality of energy recovery $I_{in}$ current pulses flow in the direction indicated by arrow 1404, and charge capacitor 712. As discussed previously, voltage $V_{cap}$ 720 is stored in capacitor 712 and is fed to energy module 606 via connection 616 for recovery. Capacitor voltage $V_{cap}$ 720 charges energy module 606, which may comprise a battery, rechargeable battery, capacitor or other electrical energy source or storage device. Accordingly, regulator 1400 transforms the energy supplied by $V_{in}$ 615 and feeds it to energy module 606 via connection 616 under the control of controller 602 and switch 708.

Figure 15:
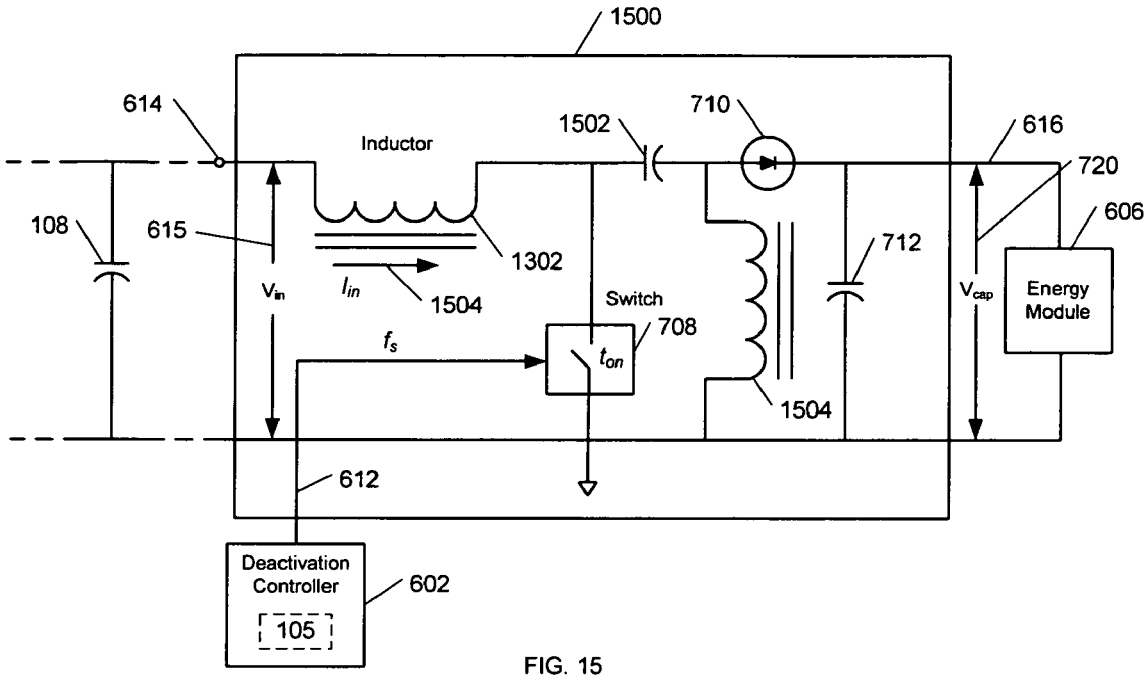
FIG. 15 illustrates a diagram in accordance with one embodiment.

FIG. 15 illustrates one embodiment of energy recovery module 112 comprising regulator 1500 arranged in a SEPIC topology. In one embodiment, regulator 1300 may comprise one end of first high frequency power inductor 1302 connected to input terminal 614, for example. This end of first high frequency power inductor 1302 may be connected to capacitor 108. The other end of first high frequency power inductor 1302 may be connected to the input of switch 708. At this junction, first high frequency power inductor 1302 also may be connected in series with one end of capacitor 1502. The other end of capacitor 1502 may be connected to one end of diode 710 and one end of second high frequency power inductor 1504. The other end of second high frequency power inductor 1504 may be connected to ground 716. The other end of diode 710 may be connected to capacitor 712, which is connected to energy module 606 via output terminal 616. As previously discussed with reference to FIG. 6, in one embodiment, the voltage across capacitor 108 may be rectified by rectifier 604, for example, and $V_{in}$ rectified 615 may be applied to input high frequency power inductor 1302 at input terminal 614. When switch 708 is turned "on" for period $t_{on}$ (FIG. 8) it provides a conduction path to ground 716. Controller 602 controls the operation of switch 708 and generates pulses 802 (FIG. 8) at frequency $f_s$. These pulses 802 are applied to connection 612 to control switch 708, and thus control the transformation of $V_{in}$ rectified 615. During the switch 708 turn "on" period $t_{on}$ energy recovery $I_{in}$ current pulses flow in the direction indicated by arrow 1504, are coupled through capacitor 1502 and diode 710, and charge capacitor 712. The resulting voltage developed across capacitor 712 $V_{cap}$ is fed to energy module 606 via connection 616. Capacitor voltage $V_{cap}$ charges energy module 606, which may comprise a battery, capacitor or other electrical energy source or storage device. Accordingly, regulator module 1500 transforms the energy in $V_{in}$ rectified 615 applied at input terminal 614 and delivers it to energy module 606 via connection 616 as controlled by activation and energy recovery controller 602 and switch 708.

Figure 16:
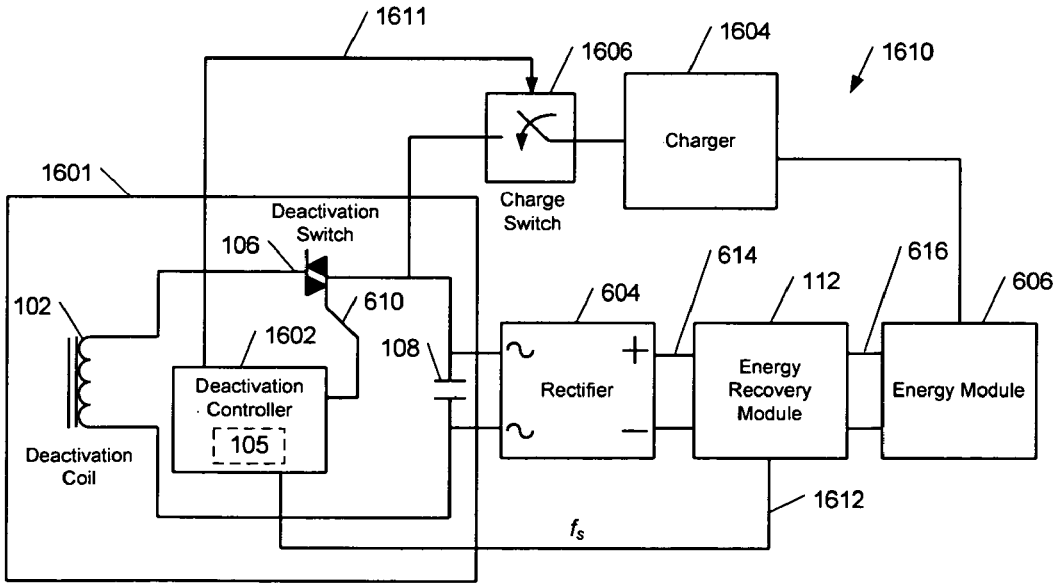
FIG. 16 illustrates a block diagram in accordance with one embodiment.

FIG. 16 shows a block diagram of one embodiment of a deactivation and energy recovery module comprising a charging module 1600. Deactivation, energy recovery, and charging module 1600 comprises deactivation module 1601, and also comprises energy recovery module 112 arranged in any one of the topologies previously described with respect to FIGS. 7, 13, 14, and 15 (e.g. flyback, boost, buck, and SEPIC). Deactivation module 1601 may comprise coil 102 connected to switch 106, which in turn may be connected to deactivation capacitor 108. Deactivation capacitor charging module 1604 (charging module) may be connected to charge switch 1606 and to energy module 606. Module 1600 also may comprise a charging loop 1610 connecting energy module 606 to charging module 1604 and charge switch 1606. Charging loop 1610 provides a conduction path for charging deactivation capacitor 108 from energy module 606, for example. The output end of charge switch 1606 is connected to capacitor 108 and the input end of charge switch 1606 is connected to charging module 1604. Charge switch 1606 may be controlled by deactivation, energy recovery, and charging control module 1602 (controller) through connection 1611. In operation, charging module 1604 charges deactivation capacitor 108 when charge switch 1606 is turned "on" by controller 1602. In one embodiment, energy for charging deactivation capacitor 108 may be supplied by energy module 606, for example.

Controller 1602 may control the deactivation and energy recovery function of deactivation module 1601. In one embodiment, controller 1602 also may control the operation of switch 106 via connection 610. By regulating switch 106, controller 1602 controls the voltage waveform across deactivation capacitor 108 such that the ring-down decay voltage meets predetermined characteristics, as previously described. In one embodiment, module 1600 also comprises energy and recovery module 112 connected to deactivation capacitor 108. Other embodiments may provide energy recovery module 112 connected across coil 102 (not shown) or connected to module 1600 via capacitive or inductive coupling (not shown), for example. Controller 1602 also may control the operation of energy recovery module 112 via connection 1612. In one embodiment, rectifier 604 may be located between deactivation capacitor 108 and energy recovery module 112. Rectifier 604 may be a full or half wave rectifier, for example. Various embodiments of energy recovery module 112 and techniques may be adapted to function with either a full or half wave rectifier 604, for example, or may operate without rectifier 604. In embodiments comprising rectifier 604, the voltage across deactivation capacitor 108 is rectified by rectifier 604. The rectified voltage is then fed to the input of the energy recovery module 112 at input terminal 614, for example. Energy recovery module 112 then transforms the energy in rectified input voltage, for example, and feeds it to energy module 606 via output terminal 616. In one embodiment, energy module 606 may be a battery, for example, or other device that produces electricity. In one embodiment, energy module 606 may be a rechargeable battery, a capacitor or other energy storage device, such that recovered energy may be stored for later use during the deactivation period. In operation, under the control of controller 1602 through connection 1612, charge switch 1606 turns "on" and completes the charging loop 1610. While charge switch 1606 is in the "on" state, charging module 1604 charges capacitor 108 with the charge energy supplied by energy module 606.

Figure 17:
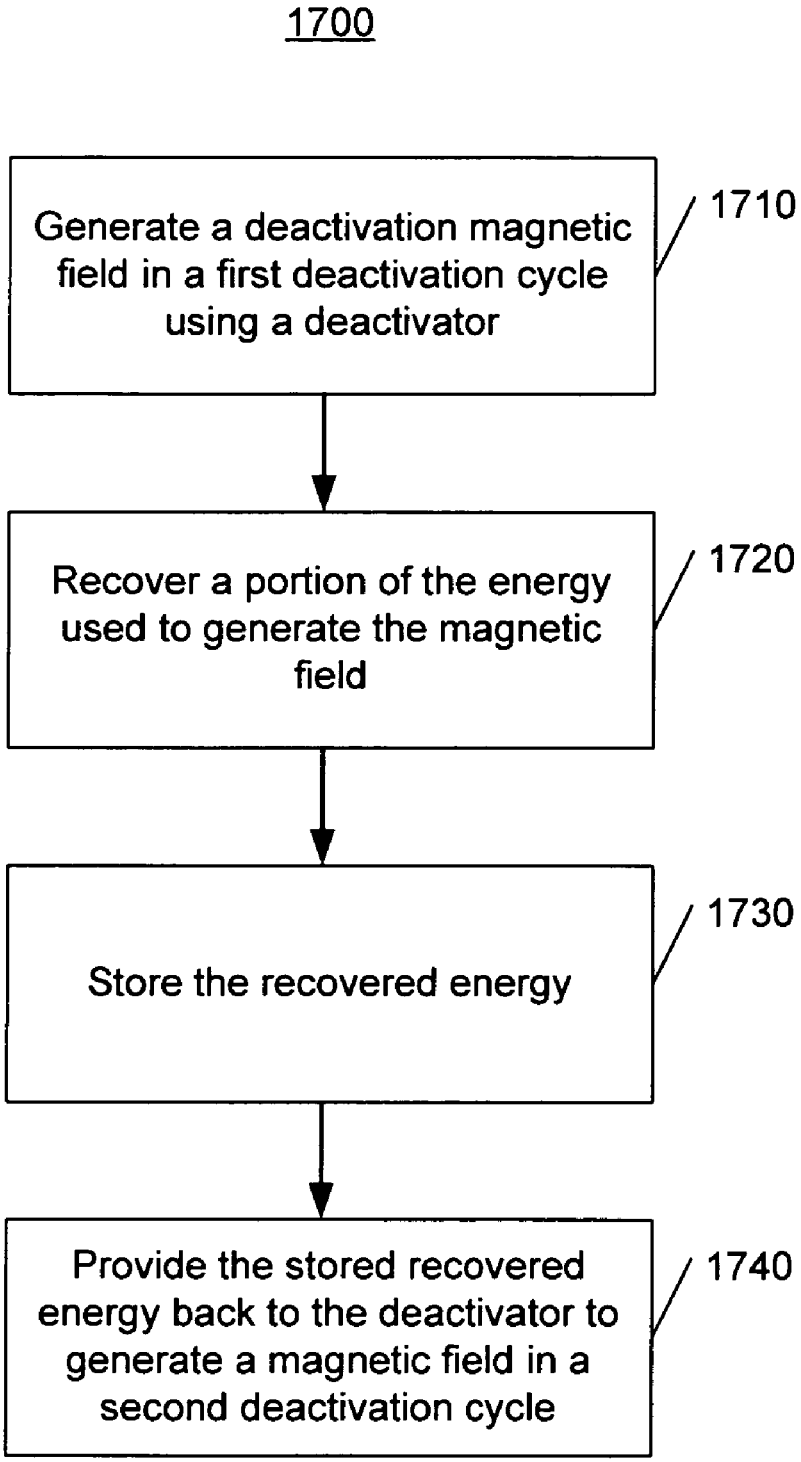
FIG. 17 illustrates a programming logic in accordance with one embodiment.

FIG. 17 illustrates a logic flow diagram representative of a checkout and/or exit process in accordance with one embodiment. In one embodiment, FIG. 17 may illustrate a programming logic 1700. Programming logic 1700 may be representative of the operations executed by one or more structures described herein, such as systems 100, 200, 400, 600, 700, 1300, 1400, 1500, and 1600. As shown in diagram 1700, the operation of the above described systems and associated programming logic may be better understood by way of example.

Accordingly, at block 1710, the system comprising a deactivator generates a deactivation magnetic field in a first deactivation cycle. At block 1720 a portion of the energy used to generate the deactivation magnetic field that normally would be dissipated in the deactivator circuit is recovered. At block 1730, the recovered portion of the energy is stored for later use. As previously described, recovering a portion of the energy comprises, for example receiving a first voltage signal portion of the portion of the energy to be recovered and converting the first voltage signal to a second voltage signal at a predetermined rate. The second voltage signal then stored in an energy module. At block 1740 the stored recovered energy is provided back to the deactivator to generate the magnetic field in a second deactivation cycle.

Numerous specific details have been set forth herein to provide a thorough understanding of the embodiments. It will be understood by those skilled in the art, however, that the embodiments may be practiced without these specific details. In other instances, well-known operations, components and modules have not been described in detail so as not to obscure the embodiments. It can be appreciated that the specific structural and functional details disclosed herein may be representative and do not necessarily limit the scope of the embodiments.

It is also worthy to note that any reference to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. It should be understood that these terms are not intended as synonyms for each other. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

While certain features of the embodiments have been illustrated as described herein, many modifications, substitutions, changes and equivalents will now occur to those skilled in the art. It is therefore to be understood that the appended claims are intended to cover all such modifications and changes as fall within the true spirit of the embodiments.

The invention claimed is:

1. An apparatus, comprising:

a deactivator for deactivating an EAS device having a deactivation antenna coil and a capacitor to store energy, said deactivator to convert said stored energy to an alternating current over a deactivation period, said alternating current to generate a deactivation magnetic field when driven through said deactivation antenna coil during said deactivation period, said alternating current defining a ring down envelope during said deactivation period; and an energy recovery module having an electrical impedance coupled to said deactivator to recover a portion of said energy converted to said alternating current during a portion of said deactivation period based on said impedance.

2. The apparatus of claim 1, wherein said energy recovery module is coupled to said deactivation antenna coil.

3. The apparatus of claim 1, wherein said energy recovery module is coupled to said capacitor.

4. The apparatus of claim 1, wherein said energy recovery module is coupled to said deactivator through an energy coupling capacitor.

5. The apparatus of claim 1, wherein said energy recovery module is coupled to said deactivator through an energy coupling inductor.

6. The apparatus of claim 1, further comprising a rectifier coupled between said deactivator and said energy recovery module to rectify a voltage of said capacitor.

7. The apparatus of claim 1, further comprising an energy module coupled to said energy recovery module to store said portion of energy recovered by said energy recovery module.

8. The apparatus of claim 1, wherein said deactivator comprises a controller to generate a signal having a frequency and duty cycle to control said impedance of said energy recovery module.

9. The apparatus of claim 8, wherein said energy recovery module comprises a switch coupled to said controller, said switch to receive said signal to activate said switch for an on time period and to deactivate said switch for an off time period of said duty cycle.

10. The apparatus of claim 9, wherein said frequency remains constant during said deactivation period.

11. The apparatus of claim 9, wherein said frequency is variable during said deactivation period.

12. The apparatus of claim 9, wherein said duty cycle remains constant during said deactivation period.

13. The apparatus of claim 9, wherein said duty cycle is variable during said deactivation period.

14. The apparatus of claim 8, wherein said signal varies said impedance of said energy recovery module at different times during said deactivation period to change said ring down envelope.

15. The apparatus of claim 8, wherein said controller comprises a processor to generate said signal.

16. A method for deactivating an EAS device, comprising:

generating a deactivation magnetic field during a deactivation period by a deactivator using energy stored in an energy storage device; and recovering a portion of said energy used to generate said deactivation magnetic field by an energy recovery module, said energy defining a ring down envelope.

17. The method of claim 16, further comprising:

storing said recovered portion of the energy.

18. The method of claim 16, wherein recovering said portion of the energy comprises: providing said stored recovered energy to said deactivator to generate said magnetic field in a second deactivation cycle.

19. The method of claim 16, further comprising rectifying said energy.

20. The method of claim 16, further comprising changing said ring down envelope during said deactivation period.

* * * * *